US007786863B2

(12) United States Patent
Koyama

(10) Patent No.: US 7,786,863 B2
(45) Date of Patent: Aug. 31, 2010

(54) INFORMATION PROCESSING AND WIRELESS COMMUNICATION DEVICE WHEREIN THE RESONANT FREQUENCY OF AN ANTENNA CIRCUIT IS REGULARLY CORRECTED REGARDLESS OF TEMPERATURE

(75) Inventor: Jun Koyama, Sagamihara (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 260 days.

(21) Appl. No.: 11/367,482

(22) Filed: Mar. 6, 2006

(65) Prior Publication Data

US 2006/0220863 A1 Oct. 5, 2006

(30) Foreign Application Priority Data

Mar. 16, 2005 (JP) ..... 2005-074718

(51) Int. Cl.
*G08B 13/14* (2006.01)

(52) U.S. Cl. ..... 340/572.1; 340/10.1; 343/700 R

(58) Field of Classification Search ..... 340/572.1, 340/572.5, 572.7, 10.1; 455/39, 41.2; 343/700 R
See application file for complete search history.

(56) References Cited

U.S. PATENT DOCUMENTS

| | | | | |
|---|---|---|---|---|
| 4,725,767 | A * | 2/1988 | Mori | 323/218 |
| 5,170,496 | A * | 12/1992 | Viereck | 455/121 |
| 6,164,532 | A | 12/2000 | Suga et al. | |
| 6,194,993 | B1 | 2/2001 | Hayashi et al. | |
| 6,411,200 | B1 | 6/2002 | Kawagishi | |
| 6,525,595 | B2 | 2/2003 | Oku | |
| 6,608,550 | B2 | 8/2003 | Hayashi et al. | |
| 2005/0052282 | A1 * | 3/2005 | Rodgers et al. | 340/572.1 |
| 2005/0104790 | A1 * | 5/2005 | Duron | 343/745 |

FOREIGN PATENT DOCUMENTS

| | | |
|---|---|---|
| JP | 2001-250096 | 9/2001 |
| JP | 2001-250393 | 9/2001 |
| JP | 2003-162696 | 6/2003 |
| JP | 2005-063123 | 3/2005 |
| JP | 2005063123 A * | 3/2005 |
| JP | 2005-210213 | 8/2005 |

* cited by examiner

*Primary Examiner*—Toan N Pham
*Assistant Examiner*—Kerri McNally
(74) *Attorney, Agent, or Firm*—Eric J. Robinson; Robinson Intellectual Property Law Office, P.C.

(57) ABSTRACT

An information processing device of the invention has an antenna circuit, and a reader/writer device provided with a received signal generating circuit, a microcomputer, a transmitted signal generating circuit, a level detecting circuit, and a D/A converter. The received signal generating circuit is connected to the microcomputer and the antenna circuit, the transmitted signal generating circuit is connected to the microcomputer and the antenna circuit, the D/A converter is connected to the microcomputer and the antenna circuit, the level detecting circuit is connected to the microcomputer and the antenna circuit, and the antenna circuit has an antenna, a resonant capacitor, and a variable capacitor.

32 Claims, 13 Drawing Sheets

INFORMATION PROCESSING AND WIRELESS COMMUNICATION DEVICE WHEREIN THE RESONANT FREQUENCY OF AN ANTENNA CIRCUIT IS REGULARLY CORRECTED REGARDLESS OF TEMPERATURE

BACKGROUND OF THE INVENTION

1. Field of the Invention

The present invention relates to an information processing device that stores and/or reads necessary information by a contactless means such as wireless communication. In particular, the invention relates to a reader/writer device (also called an interrogator or a controller) that reads/writes information from/to an IC chip (also called an ID chip, an IC tag, an ID tag, an RF tag, a wireless tag, an electronic tag, or a transponder) for RFID (Radio Frequency Identification).

2. Description of the Related Art

With development of computer technologies and improvement of image recognition technologies, information identification utilizing media such as bar codes has spread widely and been used for identification of product data and the like. It is expected that the amount of information to be identified will further increase in the future. On the other hand, information identification utilizing bar codes is disadvantageous in that a bar code reader is required to be in contact with bar codes, and the amount of data stored in bar codes cannot be increased so much. Therefore, contactless information identification and increase in the storage capacity of media are required.

In view of the foregoing requirements, a contactless IC chip for RFID (hereinafter referred to as an IC chip) and a reader/writer device (hereinafter referred to as a reader/writer) have been developed in recent years. The IC chip has a memory circuit to store necessary information, and the information inside is read by a reader/writer using a contactless means, generally a wireless means. It is expected that practical application of an information processing device for reading information stored in such an IC chip allows commercial distribution and the like to be simplified and reduced in cost while ensuring high security.

An RFID system using an IC chip is briefly described with reference to FIG. 13. FIG. 13 is a block diagram showing as a conventional technology a reader/writer disclosed in Patent Document 1. FIG. 13 is configured by an IC chip 1301, a reader/writer 1302, and a high-level device 1303. The high-level device 1303 here exchanges data processing instructions and data processing results with the IC chip 1301 via the reader/writer 1302, thereby controlling identification of the individual information.

The reader/writer 1302 is configured by a receiving portion 1304, a transmitting portion 1305, a control portion 1306, an interface portion 1307, antennas 1308, and resonant capacitors 1309. The high-level device 1303 controls the control portion 1306 via the interface portion 1307 so that the control portion 1306 controls the receiving portion 1304 and the transmitting portion 1305 with respect to data processing instructions and data processing results. The transmitting portion 1305 modulates data processing instructions that are to be transmitted to the IC chip 1301, and outputs them as electromagnetic waves from the antenna 1308. The receiving portion 1304 demodulates electromagnetic waves received by the antenna 1308, and outputs them as data processing results to the control portion 1306.

In receiving data, the antennas 1308 and the resonant capacitors 1309 (hereinafter referred to as an antenna circuit 1310), which are connected to the receiving portion 1304 and the transmitting portion 1305 and configure an LC parallel resonant circuit, receive, as an electrical signal, electromotive force that is induced in the antenna circuit 1310 by electromagnetic waves outputted from the IC chip 1301. Meanwhile, in transmitting data, induced current is supplied to the antenna circuit 1310, and the antennas 1308 transmit electromagnetic waves to the IC chip 1301.

Although details are omitted, the IC chip 1301 also has an LC parallel resonant circuit configured by an antenna and a resonant capacitor, and electromagnetic waves are received from and transmitted to the antennas 1308 in the reader/writer 1302.

The aforementioned antenna circuit 1310 has a unique resonant frequency f0 that is determined by the inductance of the antenna 1308 and the capacitance of the resonant capacitor 1309. When individual information is exchanged in an RFID system, the resonant frequency f0 of the antenna circuit 1310 in the reader/writer 1302 is required to be substantially equal to a transmitting frequency fc that is outputted from the transmitting portion 1305. The resonant frequency f0 of the antenna circuit 1310 here is set so as to satisfy the formula (1), wherein L is the inductance of the antenna 1308 and C is the capacitance of the resonant capacitor 1309.

$$f0=1/\{2\pi(LC)^{1/2}\} \quad (1)$$

When the resonant frequency f0 is equal to the transmitting frequency fc outputted from the transmitting portion 1305, data can be transmitted and received the most effectively. Therefore, in the antenna circuit 1310, the resonant frequency f0 is preset to be equal to the transmitting frequency fc.

It is to be noted that the frequency transmitted and received is 125 kHz, 13.56 MHz, 915 MHz, 2.45 GHz, or the like, each of which is standardized by ISO or the like. Modulation and demodulation systems in transmitting and receiving data are also standardized (for example, see Patent Document 2).

[Patent Document 1] Japanese Patent Laid-Open No. 2001-250096

[Patent Document 2] Japanese Patent Laid-Open No. 2001-250393

As set forth above, the resonant frequency f0 of an antenna circuit connected to a reader/writer is determined by the inductance of an antenna and the capacitance of a resonant capacitor. However, in an antenna circuit connected to a reader/writer, the inductance of an antenna is not so sensitive to temperature while the capacitance of a resonant capacitor is sensitive to temperature.

Since a capacitor used as a resonant capacitor is required to be reduced in size, a ferroelectric-based capacitor with large capacitance is used. A ferroelectric typified by barium titanate, which has a high dielectric constant of 1000 or more, is widely used for electronic apparatuses and highly versatile. In the ferroelectric-based capacitor, however, electrostatic capacitance has relatively high temperature dependence and electrostatic capacitance and dielectric loss change significantly.

As a result, with changes in ambient temperature, the capacitance of a resonant capacitor in an antenna unit changes and the resonant frequency f0 of an antenna circuit changes as seen in the formula (1), which causes a problem in that a received voltage level is lowered in an IC chip that receives data.

A change in the transmitting frequency fc inputted to an antenna circuit, relative to temperature, can be suppressed to several ppm by using a crystal oscillator or the like in a transmitting portion. However, in an antenna circuit having a ferroelectric-based capacitor, the electrostatic capacitance has relatively high temperature dependence as described above, and the resonant capacitance may change by several percent in some cases. Accordingly, a problem occurs in that the resonant frequency f0 changes each time ambient temperature changes and a signal transmitted from an antenna circuit is attenuated.

SUMMARY OF THE INVENTION

The invention is made in view of the foregoing problems, and provides an information processing device where the resonant frequency f0 of an antenna circuit is regularly corrected regardless of temperature so that a constant signal is inputted/outputted to/from the antenna circuit even when ambient temperature changes, thereby reading and writing information from and to an IC chip.

In order to solve the foregoing problems, the invention provides a novel information processing device.

More specifically, an information processing device of the invention has an antenna circuit, and a reader/writer device provided with a received signal generating circuit, a microcomputer, a transmitted signal generating circuit, a level detecting circuit, and a D/A converter. The received signal generating circuit is connected to the microcomputer and the antenna circuit, the transmitted signal generating circuit is connected to the microcomputer and the antenna circuit, the D/A converter is connected to the microcomputer and the antenna circuit, the level detecting circuit is connected to the microcomputer and the antenna circuit, and the antenna circuit has an antenna, a resonant capacitor, and a variable capacitor.

Another information processing device of the invention has an antenna circuit, and a reader/writer device provided with a received signal generating circuit, a transmitted signal generating circuit, a level detecting circuit, a first D/A converter, a second D/A converter, a microcomputer, and a matching circuit. The received signal generating circuit is connected to the microcomputer and the antenna circuit, the transmitted signal generating circuit is connected to the microcomputer and the antenna circuit, the first D/A converter is connected to the microcomputer and the antenna circuit, the second D/A converter is connected to the microcomputer and the matching circuit, the level detecting circuit is connected to the microcomputer and the antenna circuit, the antenna circuit has an antenna, a resonant capacitor, and a first variable capacitor, and the matching circuit has a second variable capacitor.

Another information processing circuit of the invention has an antenna circuit provided with an antenna, a resonant capacitor, and a variable capacitor; a received signal generating circuit for demodulating a voltage signal received by the antenna circuit and outputting the demodulated voltage signal to a microcomputer; a transmitted signal generating circuit for modulating a voltage signal outputted from the microcomputer and transmitting the modulated voltage signal to the antenna circuit; a D/A converter for outputting a voltage signal for changing the capacitance of the variable capacitor; and a level detecting circuit that detects an output value of the antenna circuit when the modulated voltage signal and the voltage signal for changing the capacitance of the variable capacitor from the D/A converter are inputted and that outputs the output value to the microcomputer.

Another information processing circuit of the invention has an antenna circuit provided with an antenna, a resonant capacitor, and a first variable capacitor; a received signal generating circuit for demodulating a voltage signal received by the antenna circuit and outputting the demodulated voltage signal to a microcomputer; a transmitted signal generating circuit for modulating a voltage signal outputted from the microcomputer and transmitting the modulated voltage signal to the antenna circuit; a matching circuit provided with a second variable capacitor; a first D/A converter for outputting a voltage signal for changing the capacitance of the first variable capacitor; a second D/A converter for outputting a voltage signal for changing the capacitance of the second variable capacitor; and a level detecting circuit that detects an output value of the antenna circuit when the modulated voltage signal and the voltage signal for changing the capacitance of the first variable capacitor from the first D/A converter are inputted and that outputs the output value to the microcomputer.

The level detecting circuit of the invention may have a configuration including a diode, a capacitor, and an A/D converter.

The level detecting circuit of the invention may have a configuration that regularly detects an output value of an antenna circuit.

The variable capacitor of the invention may have a configuration including a variable capacitance diode, a coupling capacitor, and a voltage supply resistor.

The antenna of the invention may be any one of a dipole antenna, a patch antenna, a loop antenna, and a Yagi antenna.

When adopting the first configuration of the invention, it is possible to provide an information processing device that can regularly operate to output the maximum signal from an antenna circuit. Thus, it is possible to provide an information processing device where the maximum signal can be obtained even when ambient temperature changes and the resonant capacitance of the antenna circuit changes. In addition, the information processing device having the configuration of the invention can regularly operate to output the maximum signal from the antenna circuit not only when ambient temperature changes but also in any environment where resonant capacitance changes.

When adopting the second configuration of the invention, impedance matching between an antenna unit and a reader/writer can be regularly performed in addition to the effect of the first configuration. Accordingly, the impedance between the antenna unit and the reader/writer can be matched even when ambient temperature changes. Further, in the information processing device having the configuration of the invention, impedance matching between the antenna unit and the reader/writer can be regularly performed not only when ambient temperature changes but also in any environment where resonant capacitance changes.

DETAILED DESCRIPTION OF THE INVENTION

Figure 1:
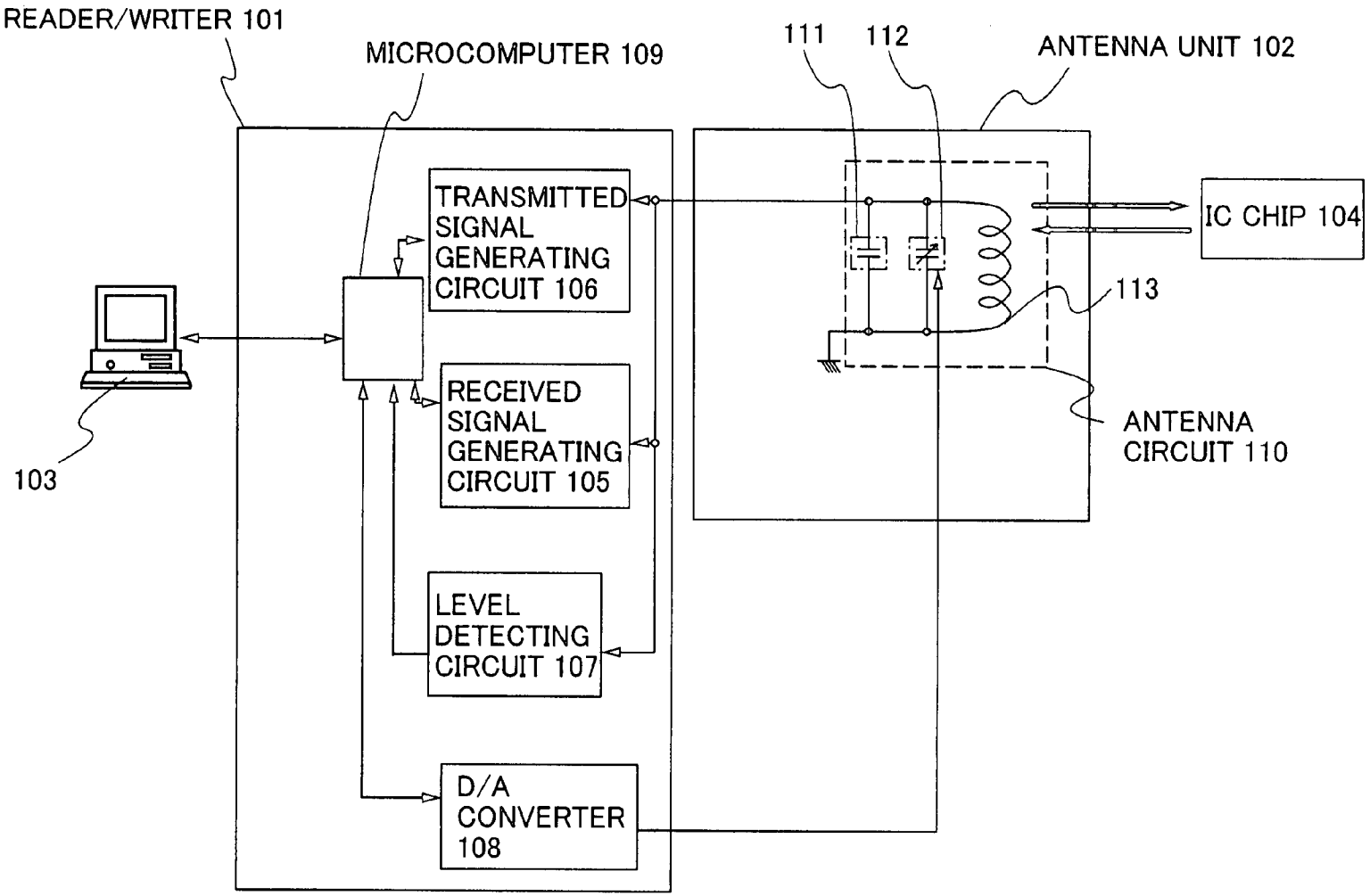
FIG. 1 is a block diagram showing a configuration according to Embodiment Mode 1 of the invention.

Although the invention will be described by way of embodiment modes and embodiments with reference to the accompanying drawings, it is to be understood that various changes and modifications will be apparent to those skilled in the art. Therefore, unless such changes and modifications depart from the scope of the invention, they should be construed as being included therein. Note that in the following drawings, the identical portions or portions having the same function are denoted by the same reference numeral, and description thereof is not repeated.

Embodiment Mode 1

FIG. 1 is a block diagram showing a configuration of an information processing device according to the first configuration of the invention. FIG. 1 is configured by a reader/writer 101, an antenna unit 102, a computer 103, and an IC chip 104. The computer 103 exchanges data processing instructions and data processing results with the IC chip 104 via the antenna unit 102 connected to the reader/writer 101, thereby controlling identification of the individual information.

The reader/writer 101 is configured by a received signal generating circuit 105, a transmitted signal generating circuit 106, a level detecting circuit 107, a D/A (digital/analog) converter 108, and a microcomputer 109. The computer 103 controls the microcomputer 109 so that the microcomputer 109 transmits/receives a voltage signal to/from the received signal generating circuit 105 and the transmitted signal generating circuit 106 with respect to data processing instructions and data processing results. The transmitted signal generating circuit 106 modulates a voltage signal of data processing instructions that are to be transmitted to the IC chip 104, and then outputs the modulated voltage signal as electromagnetic waves from the antenna unit 102. The received signal generating circuit 105 demodulates a voltage signal that is generated by electromagnetic waves received by the antenna unit 102, and outputs the demodulated voltage signal as a data processing result to the microcomputer 109. That is to say, the microcomputer 109 outputs data to the transmitted signal generating circuit 106 and processes received data outputted from the received signal generating circuit 105.

It is to be noted that in the transmitted signal generating circuit, a voltage signal of the data processing instructions to be transmitted may be modulated by modifying the amplitude, phase, or frequency thereof. If amplitude modulation is adopted in the transmitted signal generating circuit, envelope detection using a diode may be performed in a circuit for demodulating electromagnetic waves received by the IC chip. Since envelope detection can be performed using a simple circuit, an information processing device for reading a miniaturized IC chip can be provided.

The antenna unit 102 has an antenna circuit 110 that is configured by a resonant capacitor 111, a variable capacitor 112, and an antenna 113. In the antenna circuit 110, the resonant capacitor 111, the variable capacitor 112, and the antenna 113 are connected in parallel to each other, and one electrode of each is grounded. It is to be noted that the variable capacitor is an element whose capacitance can be varied by a voltage signal inputted from outside.

Note that in the antenna unit, a plurality of antenna circuits may be provided. Further, in the information processing device of the invention, an antenna circuit for receiving signals and an antenna circuit for transmitting signals may be provided separately. If a plurality of antenna circuits are provided, a plurality of received signal generating circuits and a plurality of transmitted signal generating circuits may be provided in accordance with the antenna circuits.

In this specification, connection means electrical connection unless otherwise noted.

Figure 2:
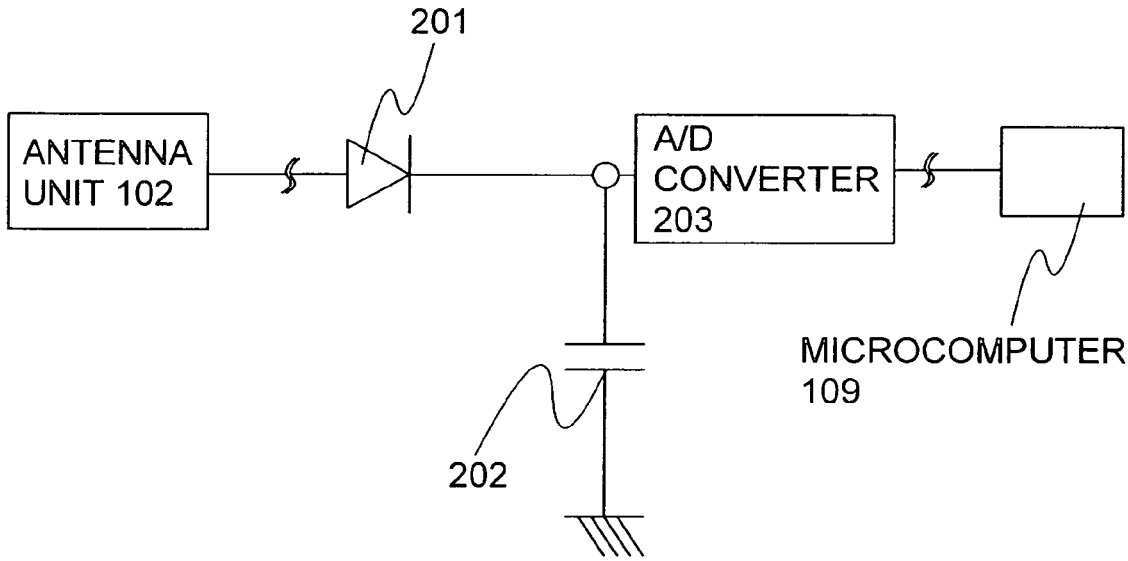
FIG. 2 is a circuit diagram of a level detecting circuit of the invention.

The level detecting circuit 107 is a circuit for detecting the level of a signal outputted from the antenna unit 102. FIG. 2 shows a configuration example of the level detecting circuit 107. The level detecting circuit 107 is configured by a diode 201, a capacitor 202, and an A/D (analog/digital) converter 203. An output signal that is transmitted from the antenna unit 102 to the IC chip 104 is inputted to the diode 201 and outputted as a half wave rectified wave. The outputted rectified half waves are smoothed by the capacitor 202. The smoothed output signal is analog-to-digital converted by the A/D converter 203, and the digitized output value is outputted to the microcomputer 109.

Figure 3:
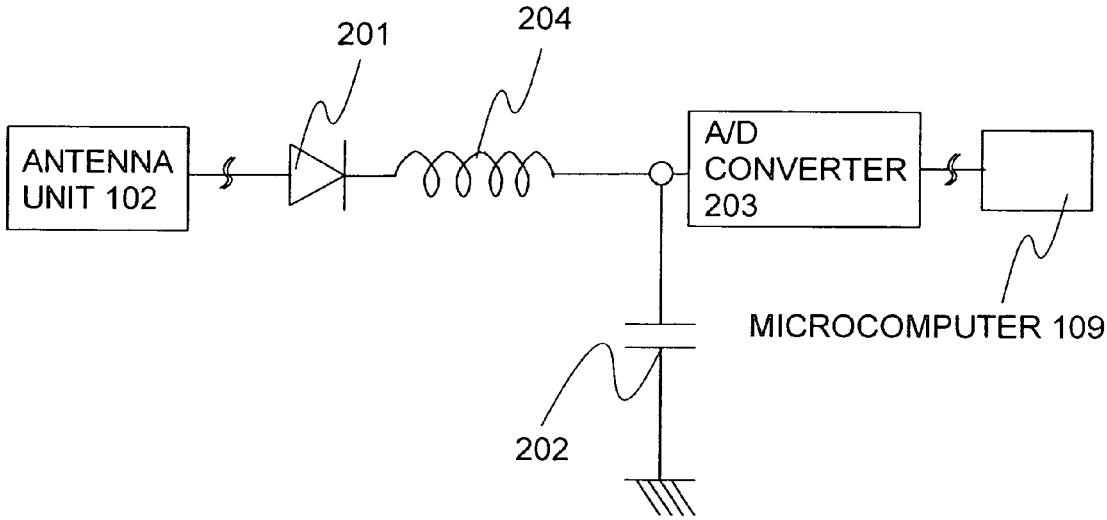
FIG. 3 is a circuit diagram of a level detecting circuit of the invention.

In the aforementioned level detecting circuit 107, an output signal that is transmitted from the antenna unit 102 to the IC chip 104 is converted into direct current by combining the rectifier circuit and the smoothing circuit; however, any circuit may be used as long as it can detect the level of an output signal. For example, a level detecting circuit using a choke coil 204 may be adopted as shown in FIG. 3. The use of the choke coil 204 can reduce the voltage fluctuation in smoothing.

The D/A converter 108 converts a digital signal outputted from the microcomputer into an analog DC voltage signal. A known D/A converter may be used as the D/A converter 108. For example, switching elements may be provided for a plurality of voltage supply lines corresponding to the number of inputted bits, so that the switching elements are selectively driven via a decoder to convert a digital signal into an analog DC voltage signal. It is needless to say that any circuit may be adopted as long as a digital signal can be converted into an analog DC voltage signal and outputted.

Figure 4:
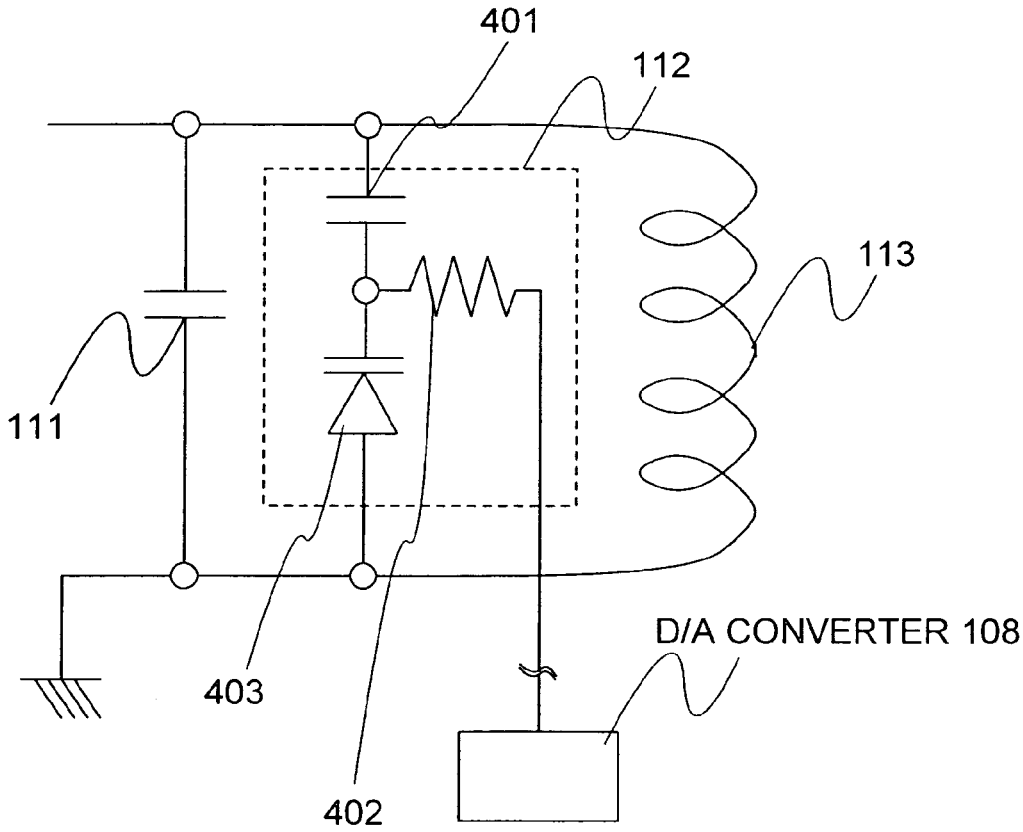
FIG. 4 is a circuit diagram of an antenna circuit of the invention.

FIG. 4 shows the antenna circuit 110 of the antenna unit 102 in more detail than FIG. 1. The antenna circuit 110 shown in FIG. 4 is an LC parallel resonant circuit that is configured by the antenna 113, the resonant capacitor 111, and the variable capacitor 112. The variable capacitor 112 in the antenna circuit 110 is configured by a coupling capacitor 401, a voltage supply resistor 402, and a variable capacitance diode 403. The voltage supply resistor 402 is connected to the D/A converter 108.

It is to be noted that in this embodiment mode, the voltage supply resistor is used to increase the impedance of a voltage source. Needless to say, any configuration may be adopted as long as the impedance of the voltage source can be increased. The coupling capacitor is used to prevent a DC voltage from being applied to a variable capacitor portion. Needless to say, any configuration may be adopted as long as a DC voltage can be prevented from being applied to the variable capacitor portion.

Figure 5:
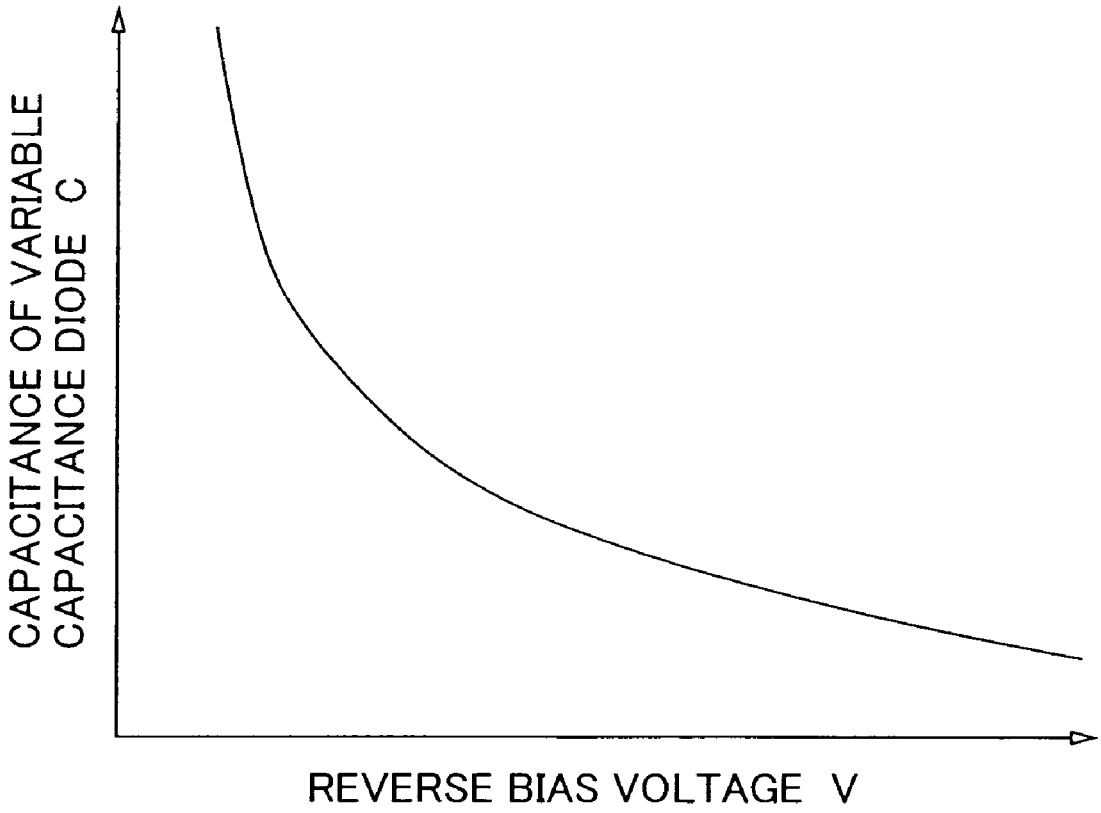
FIG. 5 is a diagram showing a relation between a voltage applied to a variable capacitor and the capacitance thereof.

In the variable capacitance diode (also called a varactor diode or a varicap), a depletion layer that is generated depending on a voltage applied to opposite ends of a PN-junction diode acts as a dielectric, and P-type and N-type regions in a semiconductor act as conductors. That is to say, the variable capacitance diode utilizes the phenomenon that a depletion layer, which is generated by a reverse bias voltage applied to a PN-junction diode, and P-type and N-type regions act as capacitors. In other words, in the variable capacitance diode, electrostatic capacitance is changed by applying a reverse bias voltage to a PN-junction diode so as to vary capacitance. FIG. 5 briefly shows a relation between a reverse bias voltage applied to a variable capacitance diode and the capacitance thereof. When a reverse bias voltage applied to a variable capacitance diode increases, the width of a depletion layer changes to reduce capacitance. Meanwhile, when the reverse bias voltage decreases, the width of a depletion layer changes to increase the capacitance.

As the antenna, an antenna corresponding to a purposive frequency may be used under the Radio Law. The frequency of a signal transmitted and received is 125 kHz, 13.56 MHz, 915 MHz, 2.45 GHz or the like, each of which is standardized by ISO or the like. Specifically, a dipole antenna, a patch antenna, a loop antenna, a Yagi antenna, and the like may be employed. The shape of an antenna may be selected in accordance with the shape and the polarized wave of an antenna connected to an IC chip. Specifically, if a dipole antenna is used as the antenna, it may be a folded dipole antenna. If a loop antenna is used as the antenna, it may be a circular loop antenna or a square loop antenna. If a patch antenna is used as the antenna, it may be a circular patch antenna or a square patch antenna.

If a patch antenna is used, the antenna preferably uses a dielectric material such as ceramic. The antenna can be miniaturized by increasing the dielectric constant of a dielectric material used for a substrate of the patch antenna. In addition, the patch antenna has high mechanical strength and thus can be used repeatedly.

A dielectric material of a patch antenna may be formed of ceramic, an organic resin, a mixture of ceramic and an organic resin, or the like. Ceramic is typified by alumina, glass, forsterite, and the like. Further, plural kinds of ceramics may be mixed to be used. In order to obtain a high dielectric constant, a dielectric layer is preferably formed of a ferroelectric material. The ferroelectric material is typified by barium titanate ($BaTiO_3$), lead titanate ($PbTiO_3$), strontium titanate ($SrTiO_3$), lead zirconate ($PbZrO_3$), lithium niobate ($LiNbO_3$), lead zirconate titanate (PZT), and the like. Further, plural kinds of ferroelectric materials may be mixed to be used.

An operation of the invention is described below. First, according to the invention, calibration of a signal transmitted from an antenna circuit is performed regularly, for example every ten minutes. This period of ten minutes is just an example and the invention is not limited thereto. The calibration is performed in the following steps.

First, a non-modulated signal with a transmitting frequency fc is inputted from the transmitted signal generating circuit 106 to the antenna circuit 110. The non-modulated signal here is a signal that is inputted from the microcomputer 109 to the transmitted signal generating circuit 106 and outputted therefrom without being modulated in amplitude, frequency, and phase.

While the non-modulated signal is inputted from the transmitted signal generating circuit 106 to the antenna circuit 110, an output voltage of the D/A converter 108 is changed by the microcomputer 109. Then, the capacitance of the variable capacitor 112 to which the output voltage of the D/A converter 108 is inputted changes, and the resonant frequency f0 of the antenna circuit 110 changes. In accordance with the change in the capacitance of the variable capacitor 112, a signal outputted from the antenna circuit 110 also changes.

When the non-modulated signal from the transmitted signal generating circuit 106 is outputted from the antenna circuit 110, a signal from the antenna circuit 110 is inputted to the level detecting circuit 107.

After the level detecting circuit 107 rectifies and smoothes a signal from the antenna circuit 110, the signal is analog-to-digital converted and outputted to the microcomputer 109. From this digital signal, the microcomputer 109 determines the output voltage value of the D/A converter 108 at which the maximum output of a non-modulated signal from the transmitted signal generating circuit 106 is obtained in the antenna circuit 110.

When calibration is not performed, a signal outputted from the antenna circuit 110 to the IC chip, which is changed by an output voltage from the D/A converter 108 is set to be the maximum value by the microcomputer 109. The setting of the output from the D/A converter 108 to the antenna circuit 110 is held until the next calibration.

In this manner, the operation is regularly performed so as to maximize the output of the signal from the antenna circuit 110. Accordingly, the maximum signal can be obtained even when the resonant capacitance of the antenna circuit changes with a change in ambient temperature.

It is to be noted that according to the first configuration of the invention, the operation to maximize the output of the signal from the antenna circuit can be regularly performed not only when resonant capacitance changes due to a change in ambient temperature but also in any environment where resonant capacitance changes.

Embodiment Mode 2

Figure 6:
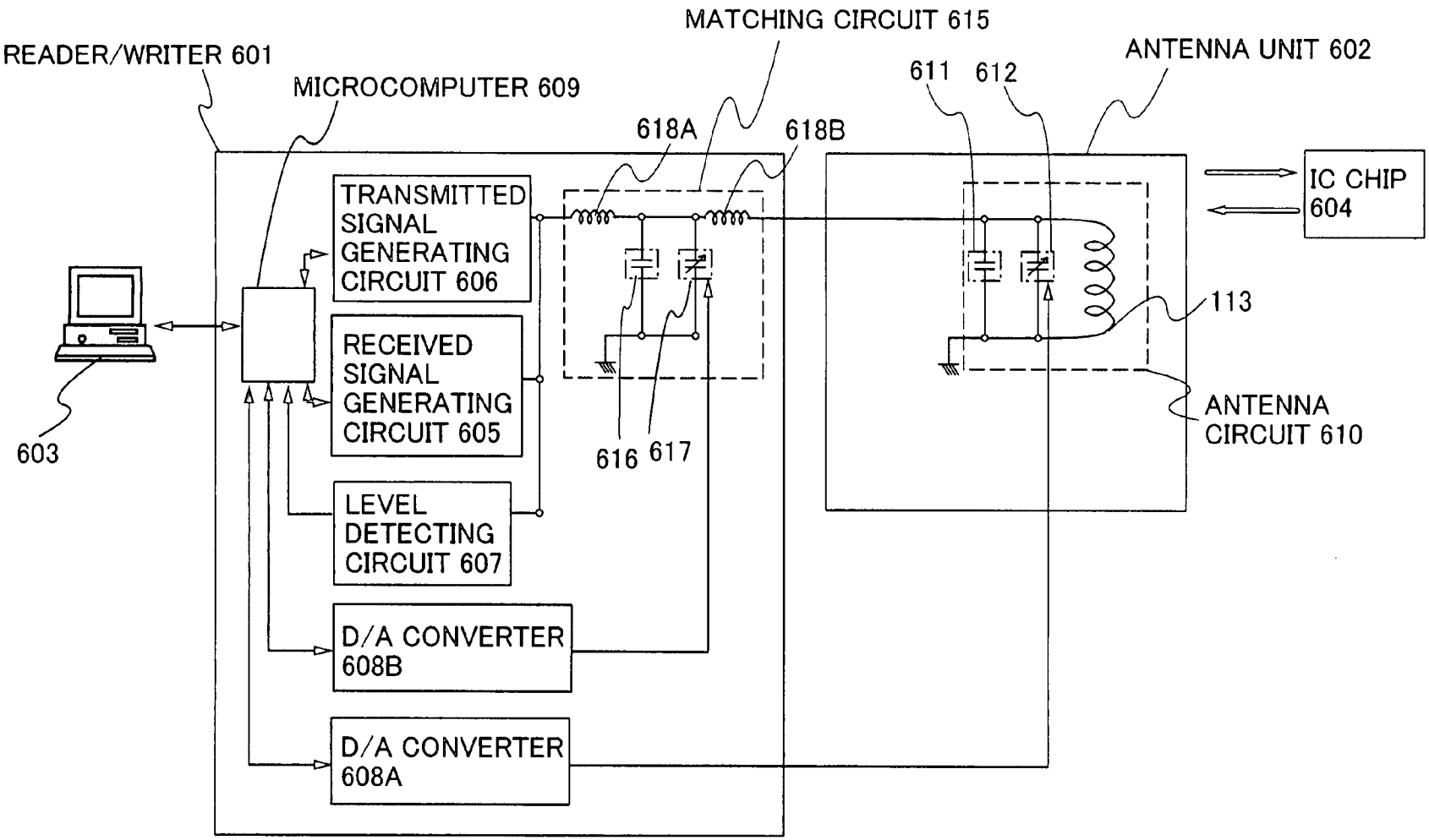
FIG. 6 is a block diagram showing a configuration according to Embodiment Mode 2 of the invention.

FIG. 6 is a block diagram showing a configuration of an information processing device according to the second configuration of the invention. FIG. 6 is configured by a reader/writer 601, an antenna unit 602, a computer 603, and an IC chip 604. The computer 603 exchanges data processing instructions and data processing results with the IC chip 604 via the antenna unit 602 connected to the reader/writer 601, thereby controlling identification of the individual information.

The reader/writer 601 is configured by a received signal generating circuit 605, a transmitted signal generating circuit 606, a level detecting circuit 607, a first D/A converter 608A, a second D/A converter 608B, a microcomputer 609, and a matching circuit 615. The computer 603 controls the microcomputer 609 so that the microcomputer 609 transmits/receives a voltage signal to/from the received signal generating circuit 605 and the transmitted signal generating circuit 606 with respect to data processing instructions and data processing results. The transmitted signal generating circuit 606 modulates a voltage signal of data processing instructions that are to be transmitted to the IC chip 604, and outputs the modulated voltage signal as electromagnetic waves from the antenna unit 602. The received signal generating circuit 605 demodulates a voltage signal that is generated by electromagnetic waves received by the antenna unit 602, and outputs the demodulated voltage signal as a data processing result to the microcomputer 609. That is to say, the microcomputer 609 outputs data to the transmitted signal generating circuit 606 and processes received data outputted from the received signal generating circuit 605.

In FIG. 6 showing a second embodiment mode of the invention, a variable capacitor is applied not only to an antenna circuit but also to a matching circuit. The matching circuit also uses LC resonance, and the signal output may be reduced when resonant capacitance changes due to a change in temperature; therefore, the resonant frequency of the matching circuit is optimized using a variable capacitor similarly to the antenna circuit. As a result, impedance matching between the antenna unit and the reader/writer can be regularly performed not only when ambient temperature changes but also in any environment where resonant capacitance changes. Thus, the information processing circuit of the invention allows favorable communication regardless of changes in ambient temperature.

The antenna unit 602 has an antenna circuit 610 that is configured by a resonant capacitor 611, a variable capacitor 612, and an antenna 613. In the antenna circuit 610, the resonant capacitor 611, the variable capacitor 612, and the antenna 613 are connected in parallel to each other, and one electrode of each is grounded. The variable capacitor is an element whose capacitance can be varied by a voltage signal inputted from outside. It is to be noted that the details of the antenna circuit 110 in the antenna unit 102 are similar to FIG. 4 shown in Embodiment Mode 1.

A matching circuit 615 for matching the impedance between the reader/writer 601 and the antenna unit 602 is configured by a resonant capacitor 616, a variable capacitor 617, a coil 618A, and a coil 618B. In the matching circuit 615, the resonant capacitor 616 and the variable capacitor 617 are connected in parallel to each other, and one electrode of each is grounded. The other electrodes of the resonant capacitor 616 and the variable capacitor 617 are both connected to the coil 618A and the coil 618B.

Figure 7:
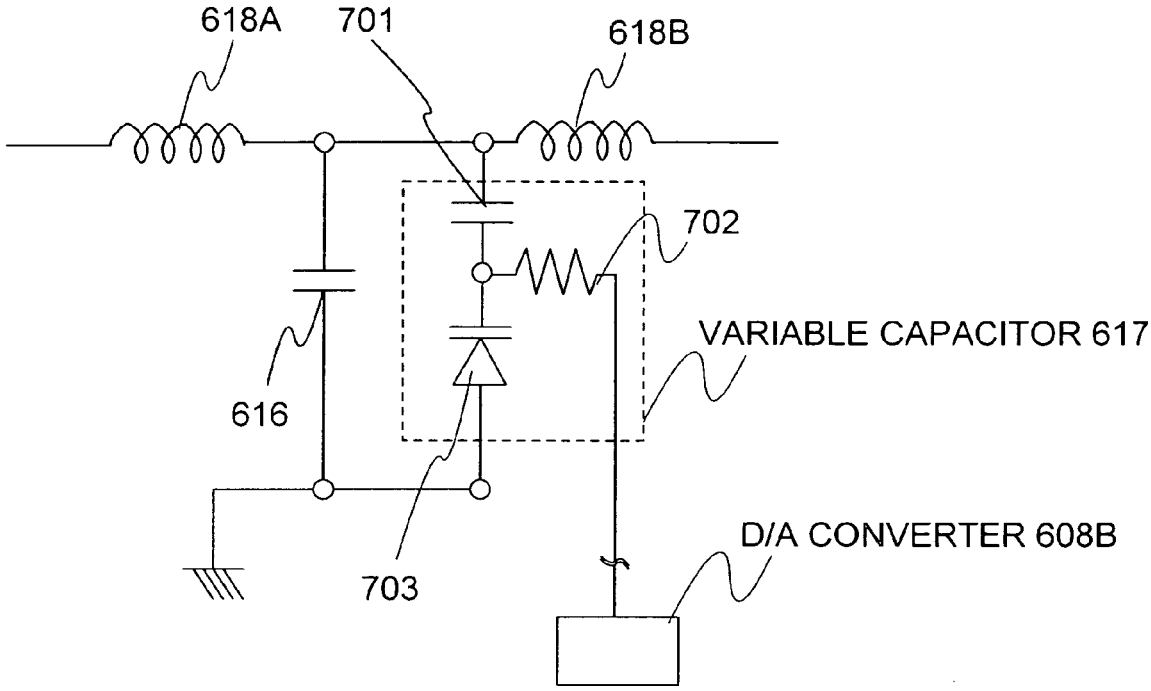
FIG. 7 is a circuit diagram of a matching circuit of the invention.

FIG. 7 shows the matching circuit 615 in more detail than FIG. 6. The matching circuit 615 in FIG. 7 is configured by the resonant capacitor 616, the variable capacitor 617, the coil 618A, and the coil 618B. The variable capacitor 617 in the matching circuit 615 is configured by a coupling capacitor 701, a voltage supply resistor 702, and a variable capacitance diode 703. The voltage supply resistor 702 is connected to the D/A converter 608B.

The matching circuit described in this embodiment mode with reference to FIG. 7 is just an example, and the invention is not limited to the configuration shown in FIG. 7. In the information processing device of the invention, any matching circuit may be used as long as a resonant capacitor is provided. It is to be noted that a coil and a capacitor for impedance matching may be appropriately provided in the matching circuit in accordance with the resistance component and reactance component of the impedance between a reader/writer and an antenna circuit that are to be designed.

The details of the variable capacitance diode are similar to FIG. 6 shown in Embodiment Mode 1.

The level detecting circuit 607 is a circuit for detecting the level of a signal outputted from the antenna unit 602. A configuration example of the level detecting circuit 607 is similar to FIGS. 2 and 3 shown in Embodiment Mode 1.

The D/A converters 608A and 608B convert a digital signal inputted from the microcomputer 609 into an analog DC voltage. A known D/A converter may be used as the D/A converters 608A and 608B. For example, switching elements may be provided for a plurality of voltage supply lines corresponding to the number of inputted bits, so that the switching elements are selectively driven via a decoder to convert a digital signal into an analog DC voltage. It is needless to say that any circuit may be adopted as long as a digital signal can be outputted as an analog DC voltage signal.

As the antenna, an antenna corresponding to a purposive frequency may be used under the Radio Law. The frequency of a signal transmitted and received is 125 kHz, 13.56 MHz, 915 MHz, 2.45 GHz, or the like, each of which is standardized by ISO or the like. Specifically, a dipole antenna, a patch antenna, a loop antenna, a Yagi antenna and the like may be employed. The shape of the antenna may be selected in accordance with the shape and the polarized wave of an antenna connected to an IC chip. Specifically, a dipole antenna may be a folded dipole antenna, a loop antenna may be a circular loop antenna or a square loop antenna, and a patch antenna may be a circular patch antenna or a square patch antenna.

If a patch antenna is used, the antenna preferably uses a dielectric material such as ceramic. The antenna can be miniaturized by increasing the dielectric constant of a dielectric material used for a substrate of the patch antenna. In addition, the patch antenna has high mechanical strength and thus can be used repeatedly.

A dielectric material of a patch antenna may be formed of ceramic, an organic resin, a mixture of ceramic and an organic resin, or the like. Ceramic is typified by alumina, glass, forsterite, and the like. Further, plural kinds of ceramics may be mixed to be used. In order to obtain a high dielectric constant, a dielectric layer is preferably formed of a ferroelectric material. The ferroelectric material is typified by barium titanate ($BaTiO_3$), lead titanate ($PbTiO_3$), strontium titanate ($SrTiO_3$), lead zirconate ($PbZrO_3$), lithium niobate ($LiNbO_3$), lead zirconate titanate (PZT), and the like. Further, plural kinds of ferroelectric materials may be mixed to be used.

An operation of the invention is described below. First, according to the invention, calibration of a signal transmitted from an antenna circuit is performed regularly, for example every ten minutes. This period of ten minutes is just an example and the invention is not limited thereto. The calibration is performed in the following steps.

First, a non-modulated signal with a transmitting frequency fc is inputted from the transmitted signal generating circuit 606 to the antenna circuit 610. The non-modulated signal here is a signal that is inputted from the microcomputer 609 to the transmitted signal generating circuit 606 and outputted therefrom without being modulated in amplitude, frequency, and phase.

While the non-modulated signal is inputted from the transmitted signal generating circuit 606 to the antenna circuit 610, an output voltage of the D/A converter 608A is changed by the microcomputer 609. Then, the capacitance of the variable capacitor 612 to which the output voltage of the D/A converter 608A is inputted changes, and the resonant frequency f0 of the antenna circuit 610 changes. In accordance with the change in the capacitance of the variable capacitor 612, a signal outputted from the antenna circuit 610 also changes.

While the non-modulated signal from the transmitted signal generating circuit 606 is outputted from the antenna circuit 610, a signal from the antenna circuit 610 is inputted to the level detecting circuit 607.

After the level detecting circuit 607 rectifies and smoothes a signal from the antenna circuit 610, the signal is analog-to-digital converted and outputted to the microcomputer 609. From this digital signal, the microcomputer 609 determines the output voltage value of the D/A converter 608A at which the maximum output of the non-modulated signal from the transmitted signal generating circuit 606 is obtained in the antenna circuit 610.

When calibration is not performed, an output signal from the antenna circuit 610 to the IC chip, which is changed by an output voltage from the D/A converter 608A is set to be the maximum value by the microcomputer 609. The setting of an output from the D/A converter 608A to the antenna circuit 610 is held until the next calibration.

After the antenna circuit is optimized, the matching circuit is optimized. First, a non-modulated signal with a transmitting frequency fc is inputted from the transmitted signal generating circuit 606 to the antenna circuit 610.

While the non-modulated signal is inputted from the transmitted signal generating circuit 606 to the antenna circuit 610, an output voltage of the D/A converter 608B is changed by the microcomputer 609. Then, the capacitance of the variable capacitor 617 to which the output voltage of the D/A converter 608B is inputted changes, and the resonant frequency f0 of the antenna circuit 610 changes. In accordance with the change in the capacitance of the variable capacitor 617, a signal outputted from the antenna circuit 610 also changes.

While the non-modulated signal from the transmitted signal generating circuit 606 is outputted from the antenna circuit 610, a signal from the antenna circuit 610 is inputted to the level detecting circuit 607.

After the level detecting circuit 607 rectifies and smoothes a signal from the antenna circuit 610, the signal is analog-to-digital converted and outputted to the microcomputer 609. From this digital signal, the microcomputer 609 determines the output voltage value of the D/A converter 608B at which the maximum output of the non-modulated signal from the transmitted signal generating circuit 606 is obtained in the antenna circuit 610.

When calibration is not performed, an output signal from the antenna circuit 610 to the IC chip, which is changed by an output voltage from the D/A converter 608B is set to be the maximum value by the microcomputer 609. The setting of an output from the D/A converter 608B to the antenna circuit 610 is held until the next calibration.

It is to be noted that optimization of resonant frequency may be performed in the order from the matching circuit to the antenna circuit.

In this manner, the operation is regularly performed so as to maximize the output of the signal. Accordingly, the maximum signal can be obtained even when the resonant capacitance of the antenna circuit and the matching circuit changes.

According to the second configuration of the invention, in addition to the effect of the first configuration of the invention described in Embodiment Mode 1, impedance matching between the antenna unit and the reader/writer can be regularly performed not only when resonant capacitance changes due to a change in ambient temperature but also in any environment where resonant capacitance changes.

Embodiment 1

In this embodiment, specific examples of the invention are described. The information processing device of the invention can be used to read data on various products each incorporating an IC chip, such as IC cards, IC tags, bills, passports, electronic apparatuses, bags, and clothes. Examples of the products each incorporating an IC chip are described with reference to FIGS. 8 to 10.

Figure 8:
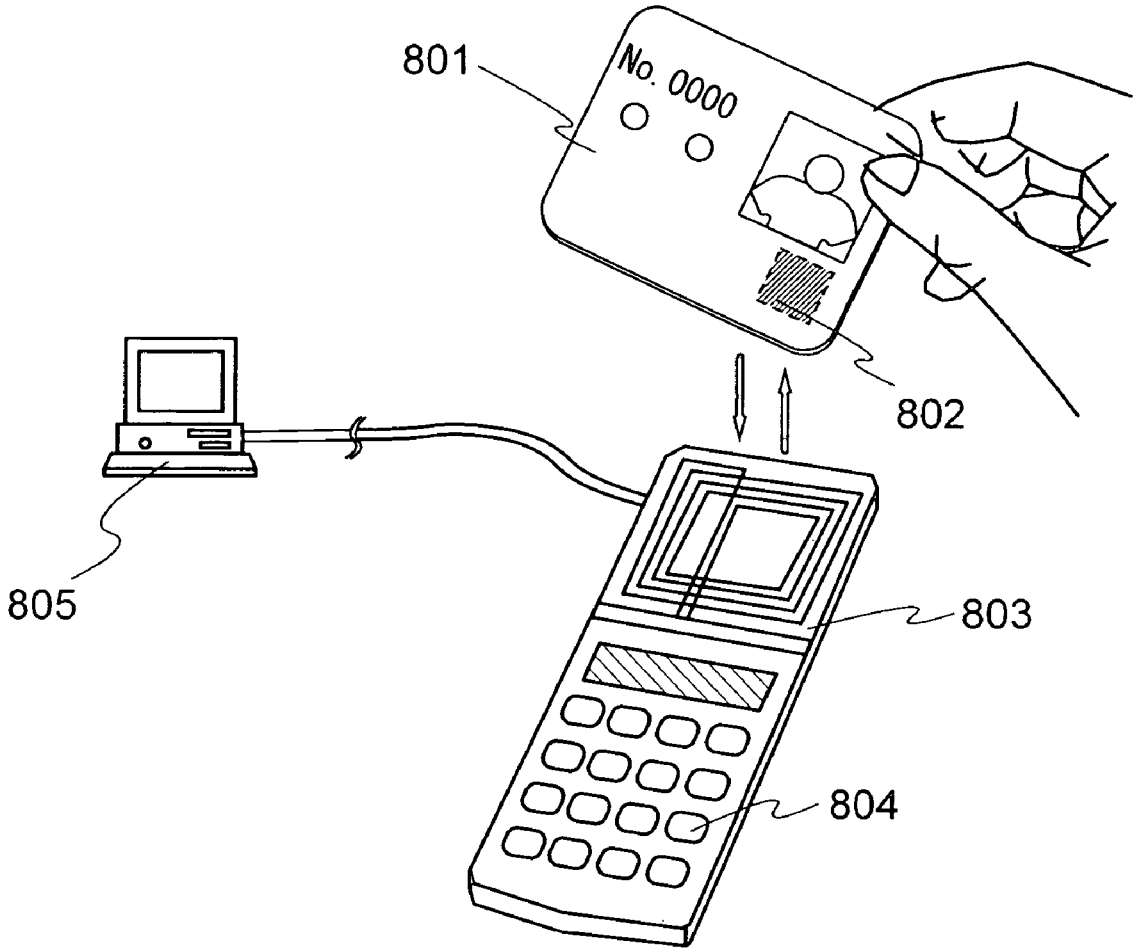
FIG. 8 is a diagram showing one mode of Embodiment 1 of the invention.

FIG. 8 shows an example where the reader/writer of the invention described in the aforementioned embodiment modes is applied to an information processing device for IC cards. The information processing device for IC cards can read/write information stored in an IC chip incorporated in an IC card, such as information on personal identification, cashless payment, and electronic money.

In FIG. 8, reference numeral 801 denotes an IC card, 802 denotes an IC chip, 803 denotes a reader/writer, 804 denotes an operating portion, and 805 denotes a computer. Information on the IC chip 802 incorporated in the IC card 801 is read/written via the reader/writer 803, and the information is stored in the computer 805.

The information processing device of the invention can adopt various forms such as a fixed information processing device and a mobile information processing device, and the operation is regularly performed so as to maximize the output of the signal in any environment (subtropical region, desert, cold region, and the like), or in an area with wide temperature swings. Accordingly, the maximum signal can be obtained even when the resonant capacitance of an antenna circuit changes. As a result, defects such as a failure in reading data from an IC chip can be reduced.

Figure 9A:
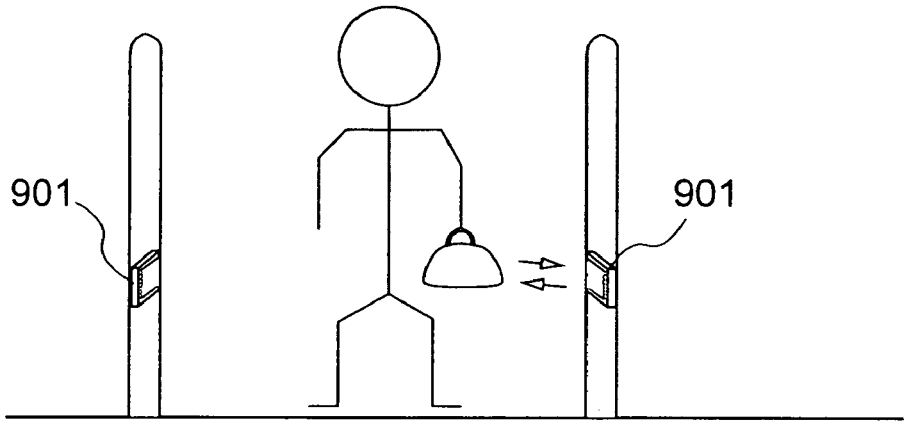
FIGS. 9A and 9B are diagrams each showing one mode of Embodiment 1 of the invention.
Figure 9B:
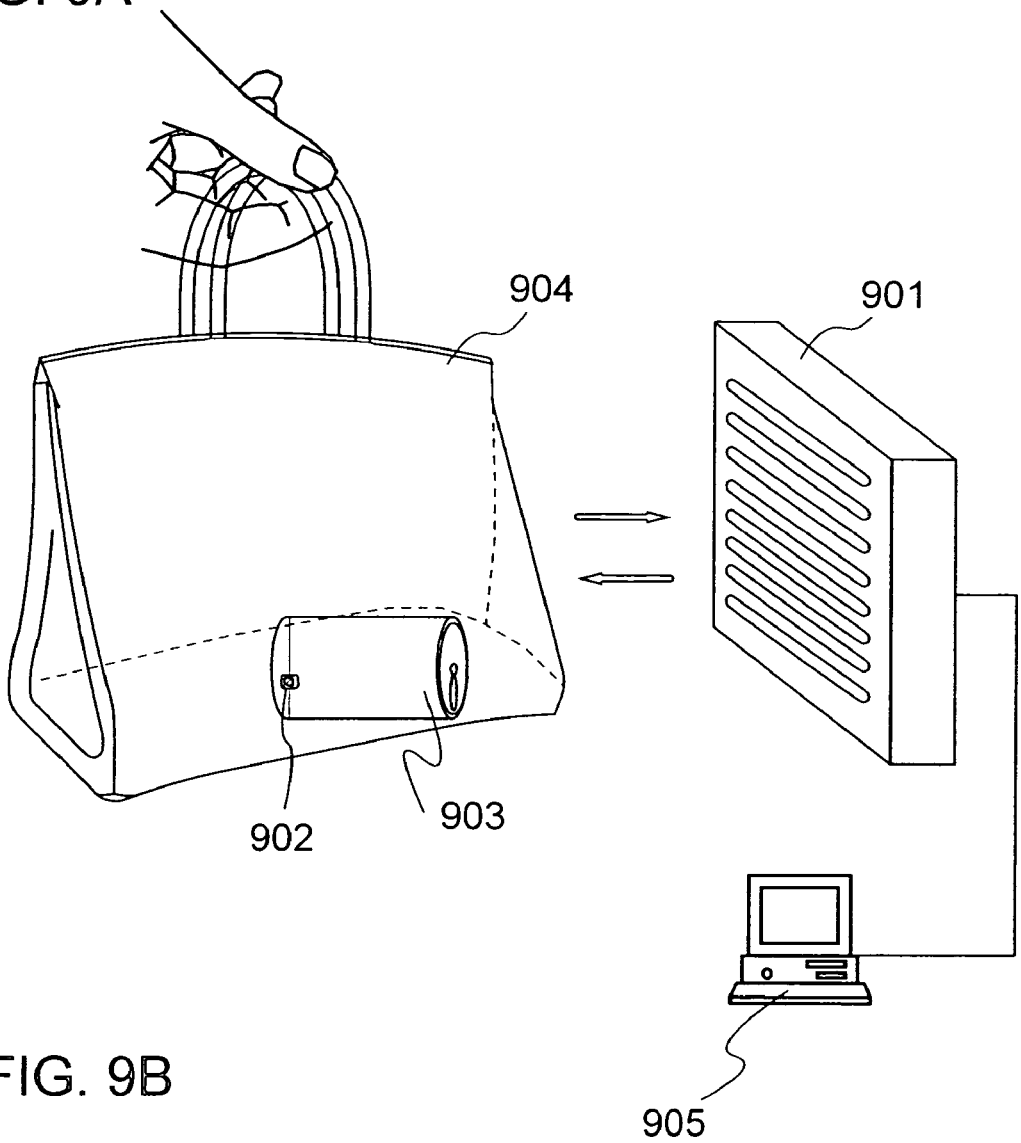

FIGS. 9A and 9B each shows an example where the reader/writer of the invention described in the aforementioned embodiment modes is applied to an information processing device for IC chips. In FIGS. 9A and 9B, reference numeral 901 denotes a reader/writer, 902 denotes an IC chip, 903 denotes a product, 904 denotes a bag, and 905 denotes a computer.

FIGS. 9A and 9B show examples where the product 903 is provided with the IC chip 902 for merchandise management in selling merchandise in retail stores such as supermarkets. According to the invention, the reader/writer 901 reads/writes individual information on the product 903, which is stored in the IC chip 902 attached to the product 903 in the bag 904, so as to refer to the computer 905 and prevent shoplifting and the like. Information on the product 903, such as transfer of payment with respect to purchase of the product in the store, can be read/written from/to the IC chip 902 attached to the product 903 in the bag 904.

The information processing device of the invention can adopt various forms such as a fixed information processing device and a mobile information processing device, and the operation is regularly performed so as to maximize the output of the signal in any environment (subtropical region, desert, cold region, and the like), or in an area with wide temperature swings. Accordingly, the maximum signal can be obtained even when the resonant capacitance of an antenna circuit changes. As a result, defects such as a failure in reading data from an IC chip can be reduced.

Figure 10:
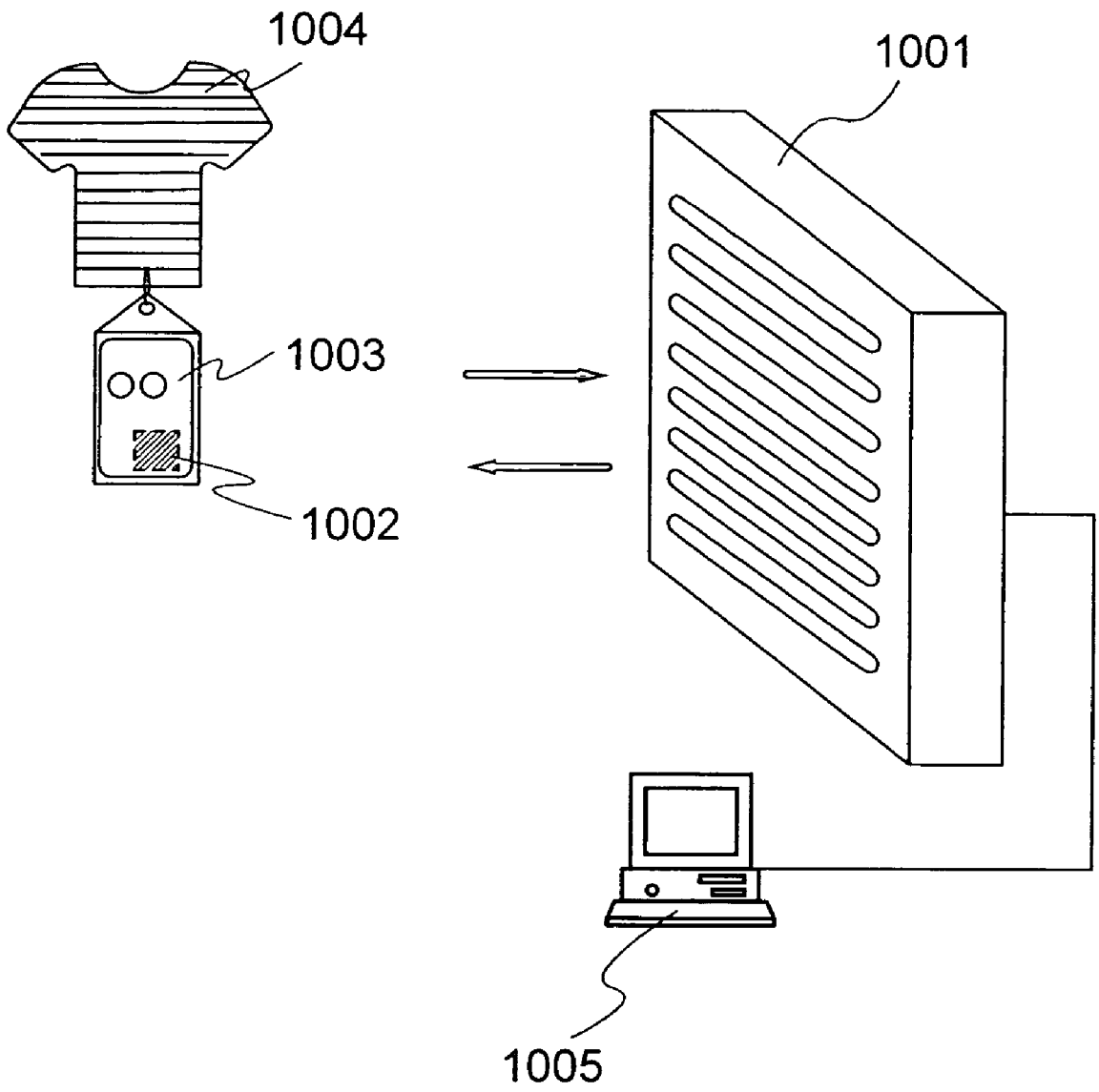
FIG. 10 is a diagram showing one mode of Embodiment 1 of the invention.

FIG. 10 shows an example where the reader/writer of the invention described in the aforementioned embodiment modes is applied to an information processing device for IC tags. In FIG. 10, reference numeral 1001 denotes a reader/writer, 1002 denotes an IC chip, 1003 denotes an IC tag, 1004 denotes a piece of clothing, and 1005 denotes a computer.

FIG. 10 shows an example of merchandise management of the piece of clothing 1004 provided with the IC tag 1003 that incorporates the IC chip 1002. According to the invention, the reader/writer 1001 reads/writes information in the IC chip 1002 in the IC tag 1003, so as to refer to the computer 1005 and facilitate stock management.

The information processing device of the invention can adopt various forms such as a fixed information processing device and a mobile information processing device, and the operation is regularly performed so as to maximize the output of the signal in any environment (subtropical region, desert, cold region, and the like), or in an area with wide temperature swings. Accordingly, the maximum signal can be obtained even when ambient temperature changes and the resonant capacitance of an antenna circuit changes. As a result, defects such as a failure in reading data from an IC chip can be reduced.

It is to be noted that the applications shown in this embodiment are just examples, and the invention is not limited to these.

As set forth above, the application range of the invention is so wide that the information processing device of the invention can read/write information in an IC chip for identification of products using the maximum signal in any environment where ambient temperature changes and the resonant capacitance of an antenna circuit changes. In addition, this embodiment may be implemented in combination with any of the aforementioned embodiment modes.

Embodiment 2

Described in this embodiment is the case where an IC chip is incorporated in various products in order to protect the security thereof, and information on the products is read/written from/to an information processing device provided in each area. Security protection can be considered in terms of anti-theft security and anti-crime security.

Figure 11:
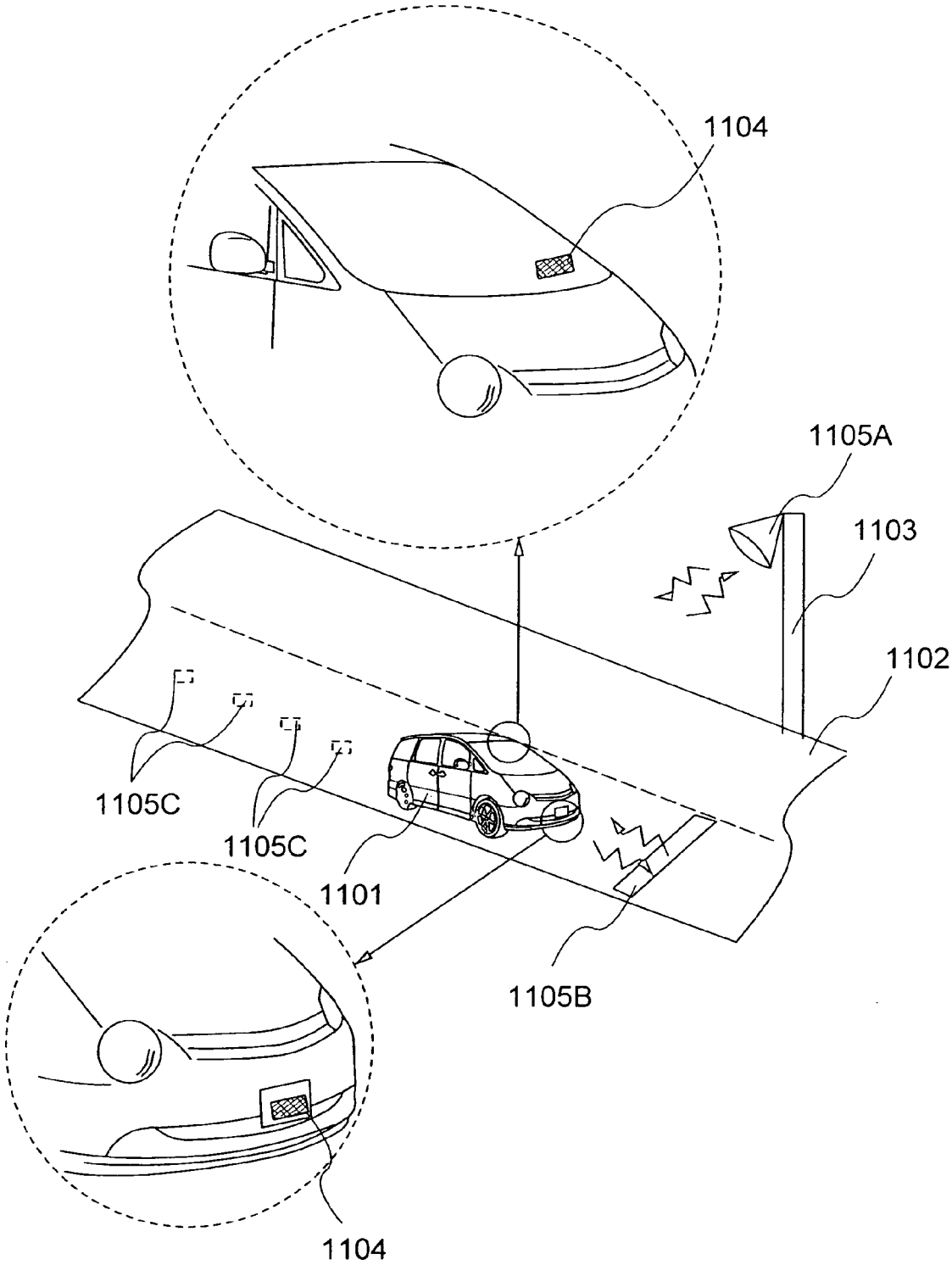
FIG. 11 is a diagram showing one mode of Embodiment 2 of the invention.

Described in this embodiment is the case where an IC chip is incorporated in a moving object such as a car and information on the moving car is read/written by a reader/writer provided in each area in the open air As shown in FIG. 11, an IC chip is incorporated in a car. For example, an IC chip may be incorporated in a license plate, a windshield, a steering wheel, or the like of a car 1101. In FIG. 11, reference numeral 1102 denotes a road, 1103 denotes a pole, 1104 denotes an IC chip, and 1105A, 1105B, and 1105C denote reader/writers.

The IC chip 1104 stores basic data such as the manufacturing date, the manufacturing location, the type of car, and personal information of the owner. Such basic data is preferably stored in a non-rewritable memory such as an MROM and then embedded in the product so as to prevent the memory from being rewritten or changed.

As shown in FIG. 11, the reader/writers are set all around the road 1102 to identify the information on the car 1101 moving on the road 1102. If the information in the IC chip 1104 of the car 1101 is read/written by the reader/writers from above, the reader/writer 1195A may be fixed to the pole 1103. Meanwhile, if the information in the IC chip 1104 of the car 1101 is read/written by the reader/writers from below as shown in FIG. 11, the reader/writer 1105B may be previously embedded in a road sign and the like provided on the surface of the road 1102. Further, if the information in the IC chip 1104 of the car 1101 is read/written while the car 1101 is moving, the reader/writers 1105C may be arranged at regular intervals in the moving direction of the car 1101.

Figure 12:
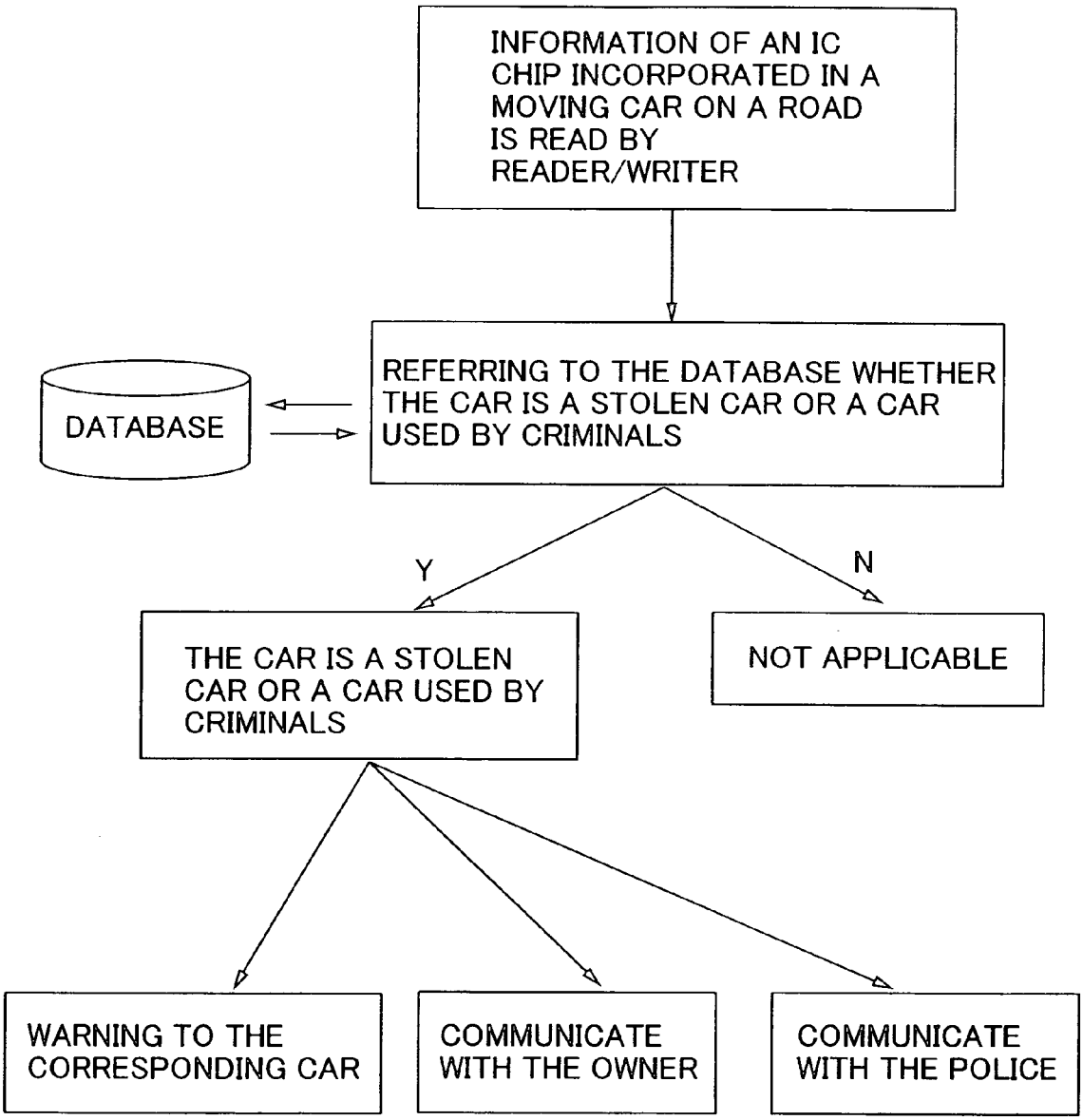
FIG. 12 is a flow chart showing one mode of Embodiment 2 of the invention.
Figure 13:
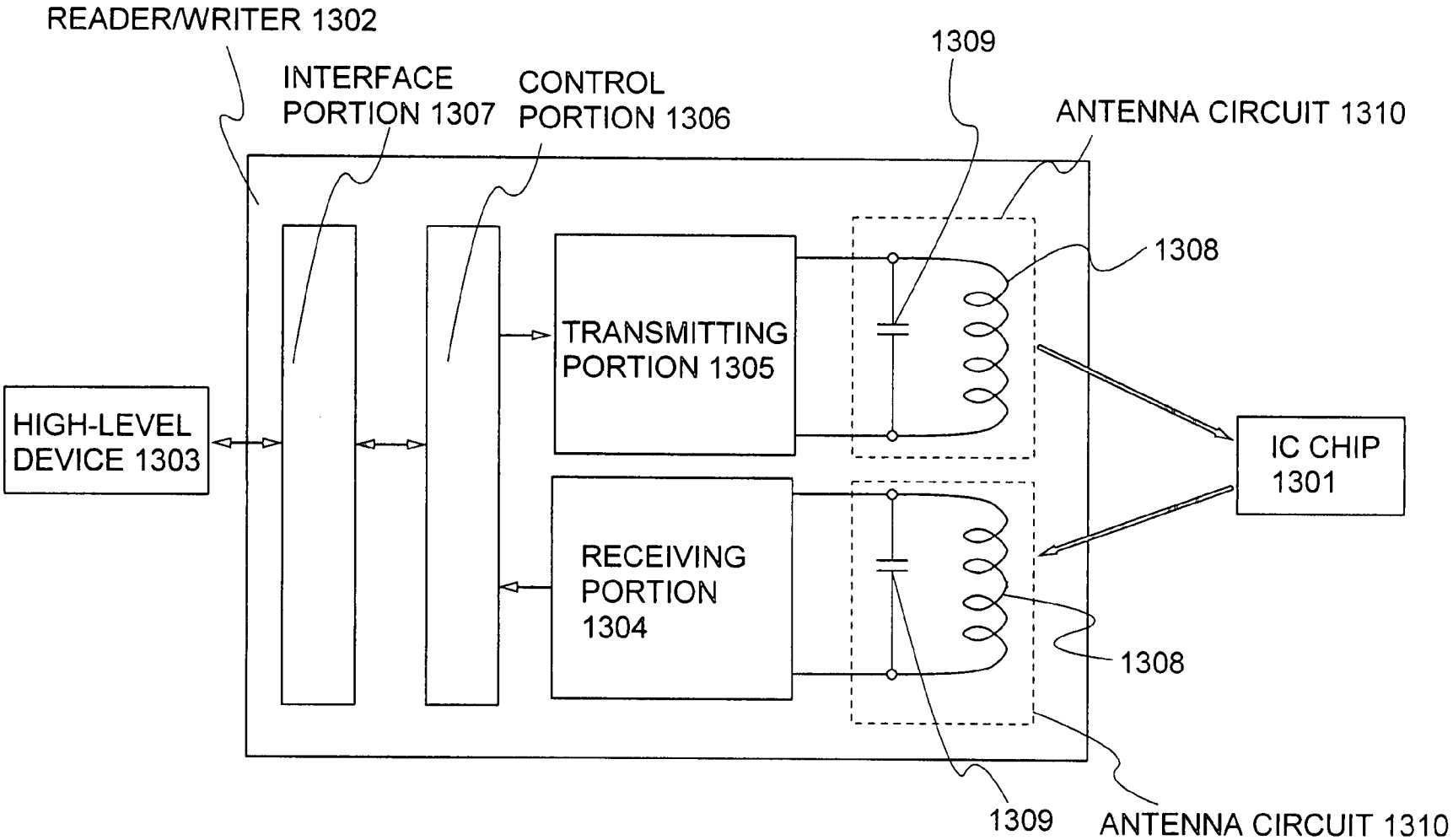
FIG. 13 is a diagram showing a conventional information processing device.

FIG. 12 briefly shows a flow chart. A reader/writer reads the information in the IC chip 1104 incorporated in the moving car, and refers to the database of a computer connected to the reader/writer whether the car is a stolen car or a car used by criminals. If the car is a stolen car or a car used by criminals, the computer can immediately communicate with the police, the owner and the like to give warning to the corresponding car.

The reader/writer described in the aforementioned embodiment modes is applied to the information processing device of the invention. When the reader/writer is set in the open air, the air temperature varies depending on various conditions such as the seasons and the weather, leading to changes in ambient temperature and changes in resonant capacitance of an antenna circuit. According to the invention, the operation is regularly performed so as to maximize the output of the signal in any environment (subtropical region, desert, cold region, and the like), or in an area with wide temperature swings. Accordingly, the maximum signal can be obtained even when ambient temperature changes and the resonant capacitance of an antenna circuit changes. As a result, defects such as a failure in reading data from an IC chip can be reduced.

The information processing device of the invention is not necessarily set on all roads, but it may be previously set on busy highways and roads leading to airports and ports.

Although a car is shown as an example of a moving object in this embodiment, the invention is not limited to this. This embodiment may be applied to a train running on a railway, as well as human beings, animals, or a bicycle traveling on a street. It is needless to say that a reader/writer may by used to refer to the database in order to obtain information of a product in a moving object. In that case, an IC chip may be previously attached to the product and the like that may be a stolen product.

It is to be noted that the applications shown in this embodiment are just examples and the invention is not limited to these aforementioned applications.

As set forth above, the application range of the invention is so wide that the information processing device of the invention can read/write information in an IC chip for identification of products using the maximum signal in any environment where ambient temperature changes and the resonant capacitance of an antenna circuit changes. In addition, this embodiment may be implemented in combination with any of the aforementioned embodiment modes.

This application is based on Japanese Patent Application serial No. 2005-074718 filed in Japan Patent Office on Mar. 16, 2005, the entire contents of which are hereby incorporated by reference.

What is claimed is:

1. An information processing device comprising:

an antenna circuit; and a reader/writer device including a received signal generating circuit, a transmitted signal generating circuit, a level detecting circuit, a first D/A converter, a second D/A converter, a microcomputer, and a matching circuit, wherein the received signal generating circuit is connected to the microcomputer and the antenna circuit;

the transmitted signal generating circuit is connected to the microcomputer and the antenna circuit;

the first D/A converter is connected to the microcomputer and the antenna circuit;

the second D/A converter is connected to the microcomputer and the matching circuit;

the level detecting circuit is connected to the microcomputer and the antenna circuit;

the antenna circuit includes an antenna, a resonant capacitor, and a first variable capacitor; and the matching circuit includes a second variable capacitor.

2. The information processing device according to claim 1, wherein the level detecting circuit comprises a diode, a capacitor, and an A/D converter.

3. The information processing device according to claim 1, wherein the level detecting circuit comprises a diode, a capacitor, an A/D converter, and a choke coil.

4. The information processing device according to claim 1, wherein at least one of the first variable capacitor and the second variable capacitor comprises a variable capacitance diode, a coupling capacitor, and a voltage supply resistor.

5. The information processing device according to claim 1, wherein the antenna is any one of a dipole antenna, a patch antenna, a loop antenna, and a Yagi antenna.

6. An information processing device comprising:

an antenna circuit including an antenna, a resonant capacitor, and a variable capacitor;

a received signal generating circuit that demodulates a voltage signal received by the antenna circuit and outputs the demodulated voltage signal to a microcomputer;

a transmitted signal generating circuit that modulates a voltage signal outputted from the microcomputer and transmits the modulated voltage signal to the antenna circuit;

a D/A converter for outputting a voltage signal for changing capacitance of the variable capacitor; and a level detecting circuit that detects an output value of the antenna circuit when the modulated voltage signal and the voltage signal for changing capacitance of the variable capacitor from the D/A converter are inputted and that outputs the output value to the microcomputer.

7. The information processing device according to claim 6, wherein the level detecting circuit comprises a diode, a capacitor, and an A/D converter.

8. The information processing device according to claim 6, wherein the level detecting circuit comprises a diode, a capacitor, an A/D converter, and a choke coil.

9. The information processing device according to claim 6, wherein the level detecting circuit regularly detects the output value.

10. The information processing device according to claim 6, wherein the variable capacitor comprises a variable capacitance diode, a coupling capacitor, and a voltage supply resistor.

11. The information processing device according to claim 6, wherein the antenna is any one of a dipole antenna, a patch antenna, a loop antenna, and a Yagi antenna.

12. An information processing device comprising:

an antenna circuit including an antenna, a resonant capacitor, and a first variable capacitor;

a received signal generating circuit that demodulates a voltage signal received by the antenna circuit and outputs the demodulated voltage signal to a microcomputer;

a transmitted signal generating circuit that modulates a voltage signal outputted from the microcomputer and transmits the modulated voltage signal to the antenna circuit;

a matching circuit including a second variable capacitor;

a first D/A converter for outputting a voltage signal for changing capacitance of the first variable capacitor;

a second D/A converter for outputting a voltage signal for changing capacitance of the second variable capacitor; and a level detecting circuit that detects an output value of the antenna circuit when the modulated voltage signal and the voltage signal for changing capacitance of the first variable capacitor from the first D/A converter are inputted and that outputs the output value to the microcomputer.

13. The information processing device according to claim 12, wherein the level detecting circuit comprises a diode, a capacitor, and an A/D converter.

14. The information processing device according to claim 12, wherein the level detecting circuit comprises a diode, a capacitor, an A/D converter, and a choke coil.

15. The information processing device according to claim 12, wherein the level detecting circuit regularly detects the output value.

16. The information processing device according to claim 12, wherein at least one of the first variable capacitor and the second variable capacitor comprises a variable capacitance diode, a coupling capacitor, and a voltage supply resistor.

17. The information processing device according to claim 12, wherein the antenna is any one of a dipole antenna, a patch antenna, a loop antenna, and a Yagi antenna.

18. A method for calibrating a resonant frequency of an information processing device, said information processing device comprising:

an antenna circuit including a variable capacitor;

a transmitted signal generating circuit connected to a microcomputer and the antenna circuit;

a D/A converter connected to the microcomputer and the variable capacitor; and a level detecting circuit connected to the microcomputer and the antenna circuit, said method comprising the steps of:

outputting a signal from the antenna circuit in accordance with a signal outputted from the transmitted signal generating circuit to the antenna circuit;

while inputting the signal from the transmitted signal generating circuit to the antenna circuit, changing an output voltage from the D/A converter to the variable capacitor by the microcomputer so that an output value of the signal outputted from the antenna circuit changes;

inputting the signal outputted from the antenna circuit to the microcomputer via the level detecting circuit; and setting the output voltage from the D/A converter to the variable capacitor by the microcomputer in accordance with the change in the output value of the signal outputted from the antenna circuit.

19. The method for calibrating a resonant frequency of an information processing device according to claim 18, wherein the level detecting circuit comprises a diode, a capacitor, and an A/D converter.

20. The method for calibrating a resonant frequency of an information processing device according to claim 18, wherein the level detecting circuit comprises a diode, a capacitor, an A/D converter, and a choke coil.

21. The method for calibrating a resonant frequency of an information processing device according to claim 18, wherein the variable capacitor comprises a variable capacitance diode, a coupling capacitor, and a voltage supply resistor.

22. The method for calibrating a resonant frequency of an information processing device according to claim 18, wherein the microcomputer sets a signal outputted to one of the transmitted signal generating circuit, and the D/A converter so as to maximize the output value of the signal outputted from the antenna circuit.

23. A method for calibrating a resonant frequency of an information processing device, said information processing device comprising:

an antenna circuit including a first variable capacitor;

a transmitted signal generating circuit connected to a microcomputer and the antenna circuit;

a matching circuit including a second variable capacitor, the matching circuit connected to the antenna circuit;

a first D/A converter connected to the microcomputer and the first variable capacitor; and a second D/A converter connected to the microcomputer and the second variable capacitor; and a level detecting circuit connected to the microcomputer and the antenna circuit, said method comprising the steps of:

outputting a signal from the antenna circuit in accordance with a signal outputted from the transmitted signal generating circuit to the antenna circuit;

while inputting the signal from the transmitted signal generating circuit to the antenna circuit, changing an output voltage from the first D/A converter to the first variable capacitor by the microcomputer so that a first change is made in an output value of the signal outputted from the antenna circuit;

inputting the first change in the output value of the signal outputted from the antenna circuit to the microcomputer via the level detecting circuit;

setting the output voltage from the first D/A converter to the first variable capacitor by the microcomputer in accordance with the first change in the output value of the signal outputted from the antenna circuit;

while inputting the signal from the transmitted signal generating circuit to the antenna circuit, changing an output voltage from the second D/A converter to the second variable capacitor by the microcomputer so that a second change is made in the output value of the signal outputted from the antenna circuit, after setting the output voltage from the first D/A converter to the first variable capacitor;

inputting the second change in the output value of the signal outputted from the antenna circuit to the microcomputer via the level detecting circuit; and setting the output voltage from the second D/A converter to the second variable capacitor by the microcomputer in accordance with the second change in the output value of the signal outputted from the antenna circuit.

24. The method for calibrating a resonant frequency of an information processing device according to claim 23, wherein the level detecting circuit comprises a diode, a capacitor, and an A/D converter.

25. The method for calibrating a resonant frequency of an information processing device according to claim 23, wherein the level detecting circuit comprises a diode, a capacitor, an A/D converter, and a choke coil.

26. The method for calibrating a resonant frequency of an information processing device according to claim 23, wherein at least one of the first variable capacitor and the second variable capacitor comprises a variable capacitance diode, a coupling capacitor, and a voltage supply resistor.

27. The method for calibrating a resonant frequency of an information processing device according to claim 23, wherein the microcomputer sets a signal outputted to one of the transmitted signal generating circuit, the first D/A converter and the second D/A converter so as to maximize the output value of the signal outputted from the antenna circuit.

28. A method for calibrating a resonant frequency of an information processing device, said information processing device comprising:

an antenna circuit including a first variable capacitor;

a transmitted signal generating circuit connected to a microcomputer and the antenna circuit;

a matching circuit including a second variable capacitor, the matching circuit connected to the antenna circuit;

a first D/A converter connected to the microcomputer and the first variable capacitor; and a second D/A converter connected to the microcomputer and the second variable capacitor; and a level detecting circuit connected to the microcomputer and the antenna circuit, said method comprising the steps of:

outputting a signal from the antenna circuit in accordance with a signal outputted from the transmitted signal generating circuit to the antenna circuit;

while inputting the signal from the transmitted signal generating circuit to the antenna circuit, changing an output voltage from the second D/A converter to the second variable capacitor by the microcomputer so that a first change is made in an output value of the signal outputted from the antenna circuit;

inputting the first change in the output value of the signal outputted from the antenna circuit to the microcomputer via the level detecting circuit;

setting the output voltage from the second D/A converter to the second variable capacitor by the microcomputer in accordance with the first change in the output value of the signal outputted from the antenna circuit;

while inputting the signal from the transmitted signal generating circuit to the antenna circuit, changing an output voltage from the first D/A converter to the first variable capacitor by the microcomputer so that a second change is made in the output value of the signal outputted from the antenna circuit, after setting the output voltage from the second D/A converter to the second variable capacitor;

inputting the second change in the output value of the signal outputted from the antenna circuit to the microcomputer via the level detecting circuit; and setting the output voltage from the first D/A converter to the first variable capacitor by the microcomputer in accordance with the second change in the output value of the signal outputted from the antenna circuit.

29. The method for calibrating a resonant frequency of an information processing device according to claim 28, wherein the level detecting circuit comprises a diode, a capacitor, and an A/D converter.

30. The method for calibrating a resonant frequency of an information processing device according to claim 28, wherein the level detecting circuit comprises a diode, a capacitor, an A/D converter, and a choke coil.

31. The method for calibrating a resonant frequency of an information processing device according to claim 28, wherein at least one of the first variable capacitor and the second variable capacitor comprises a variable capacitance diode, a coupling capacitor, and a voltage supply resistor.

32. The method for calibrating a resonant frequency of an information processing device according to claim 28, wherein the microcomputer sets a signal outputted to one of the transmitted signal generating circuit, the first D/A converter and the second D/A converter so as to maximize the output value of the signal outputted from the antenna circuit.

* * * * *